US005868271A

United States Patent [19]

Teay

[11] Patent Number: 5,868,271

[45] Date of Patent: Feb. 9, 1999

[54] LIGHT GAS TANK WITH A SAFE INLET DEVICE

[75] Inventor: Jaw-Shiunn Teay, Tainan Hsien, Taiwan

[73] Assignee: Cheng-Hua Lin, Taipei, Taiwan

[21] Appl. No.: 992,118

[22] Filed: Dec. 17, 1997

[51] Int. Cl.[6] ..... B65D 1/04

[52] U.S. Cl. ..... 220/581; 220/86.1; 220/901

[58] Field of Search ..... 220/581, 901, 220/86.1, 88.1, 4.12

[56] References Cited

U.S. PATENT DOCUMENTS

| | | | |
|---|---|---|---|
| 1,938,036 | 12/1933 | Martin et al. | 220/581 X |
| 2,294,858 | 9/1942 | Allen | 220/581 X |
| 2,673,010 | 3/1954 | Barrow | 220/86.1 X |
| 2,962,110 | 11/1960 | Depman | 220/86.1 X |
| 2,998,708 | 9/1961 | Skinner | 220/901 X |
| 4,736,779 | 4/1988 | Bernauer | 220/581 X |
| 4,841,969 | 6/1989 | Donnerhack et al. | 220/901 X |
| 4,918,927 | 4/1990 | Eigenbrod | 220/901 X |
| 5,709,252 | 1/1998 | Princiotta et al. | 220/4.12 X |

*Primary Examiner*—Steven Pollard

[57] ABSTRACT

A light gas tank with a safe inlet device includes a ring fixed on an upper surface of a light gas tank. The ring has a center fuel inlet hole, and an inverted L-shaped gas inlet on one side of the wall and an inverted L-shaped passageway on the other side of the wall. An L-shaped air tube is located in a hollow interior of the tank, having its upper end welded with a vertical portion of the gas inlet and air holes in a lower portion. An air pumping device can pump air into an inlet nozzle, the gas inlet of the ring and the L-shaped air tube, and then out of the air holes into the fuel stored in the tank to fuse with the fuel to become fuel gas for use through a control valve fixed on the tank. The pumping device is operated only when fuel gas is to be used, so no large gas pressure is produced in the tank, diminishing potent danger of explosion.

5 Claims, 5 Drawing Sheets

LIGHT GAS TANK WITH A SAFE INLET DEVICE

BACKGROUND OF THE INVENTION

This invention relates to a light gas tank with a safe inlet device, particularly to one not storing a large quantity of fuel gas to produce strong pressure in interior, and thus diminishing potent danger of explosion to a safe level.

A gas tank for cooking stored in a home may be well said a bomb possible to explode at any time, because of fuel in compressed state filled in the gas tank. And common gas tanks used in homes have the following disadvantages:

1. Inner pressure in a gas tank is very strong, so gas therein may flow out to cause an explosion, if the control valve is broken by some accident.

2. Gas in a gas tank may leak out if the control valve is not tightly closed up.

SUMMARY OF THE INVENTION

This invention has been devised to offer a light gas tank with a safe inlet device, preventing strong pressure caused by a large quantity of fuel gas produced in a gas tank from happening, and thus diminishing potent danger of explosion to a safe level.

A main feature of the invention is a ring fixed on an upper surface of a gas tank. The ring has a center inlet hole to combine with a cap threadably releasable from the ring for filling fuel in the tank. The ring is further connected with an air pumping device to pump in air through the ring and an L-shaped air tube extending from the ring into the interior of the tank to its bottom. And the lower horizontal portion of the L-shaped air tube tank is bored with air holes. Then air can flow into the fuel stored in the tank and be fused with it to produce fuel gas to be used through the control valve. And the air pumping device is only used when fuel gas is needed to be used, preventing fuel gas from produced and stored too much to cause large pressure in the tank.

Another feature of the invention is a fuel gauge provided between two joints respectively connected with the ring and a lower hole of the wall of the tank to show the height level of the fuel stored in the tank.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
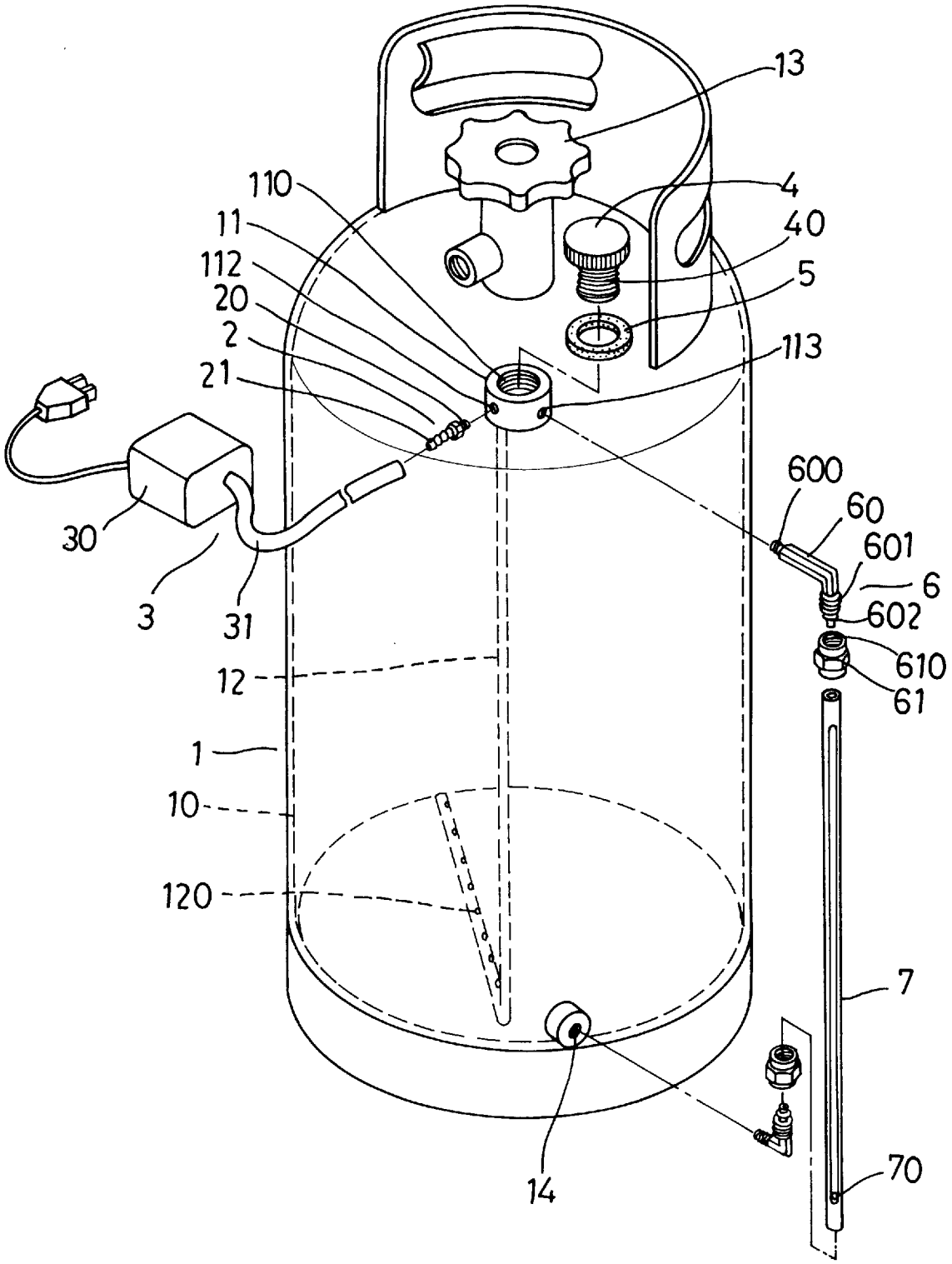
FIG. 1 is an exploded perspective view of a light gas tank with a safe inlet device in the present invention.
Figure 2:
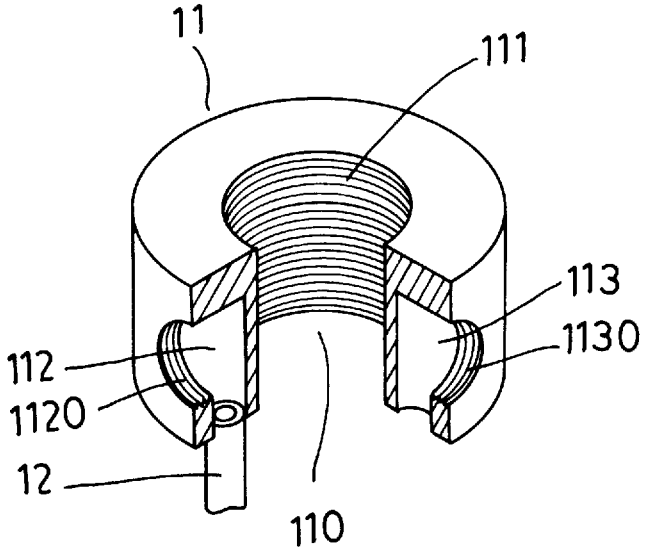
FIG. 2 is an enlarged perspective view of a ring in the present invention.

A preferred embodiment of a light gas tank with a safe inlet device in the present invention, as shown in FIGS. 1 and 2, includes a tank 1, an inlet nozzle 2, a gas pumping device 3, a cap 4, a gasket 5, two joints 6, 6 and a fuel gauge 7 as main components combined together.

The tank 1 has a hollow interior 10, a ring 11 fixed on an upper surface and formed with a center inlet hole 110, female threads 111 formed in an annular wall defining the inlet hole 110, an inverted L-shaped gas inlet 112 formed in one side of the wall, and an inverted L-shaped passageway 113 formed in the other side. The lower ends of both the gas inlet 112 and the passageway 113 communicate with the hollow interior 10 of the tank 1, and the upper ends of them open to the exterior of the ring 11. Further, the upper portions of the gas inlet 112 and the passageway 113 have female threads 1120, 1130. Further, the upper end of an L-shaped gas tube 12 is fitted in the inlet 112 from under, extending down in the interior 10 to the bottom and having a plurality of air holes 120 spaced apart in a lower horizontal portion.

Further, a control valve 13 is mounted on the center of the upper surface of the tank 1, communicating with the hollow interior 10. A lower hole 14 is bored in the lower portion of the wall of the tank 1, communicating with the hollow interior 10, and female threads 140 provided in an annular wall defining the lower hole 14.

The gas inlet nozzle 2 fits in the gas inlet 112 of the ring 11, having a male threaded end 20 to engage with the female threads 1120 of the gas inlet 112 and the other end formed with a fitting portion 21 formed with ratchet teeth.

The air pumping device 3 is combined with the fitting portion 21 of the inlet nozzle 2, having a pump 30 and a gas tube 31 fitting around the fitting portion 21 of the inlet nozzle 2.

The cap 4 closes the fuel inlet 110 of the ring 11, having male threads 40 engaging with the female threads 111 of the ring 11.

The two joints 6, 6 are L-shaped, respectively combining with the passageway 113 of the ring 11 and the lower hole 14 of tank 1, having a joint tube 60 and a constricter 61. One joint tube 60 has male threads 600 on one end to engage the female threads 1130 of the passageway 113 and proximal male threads 601 engage female threads 610 of the constricter 61 and a distal fitting portion 602 on the other end.

The fuel gauge 7 has two ends respectively fitting with the fitting portions 602 of the two joints 6, 6, and a float 70 contained in its hollow interior.

Figure 4:
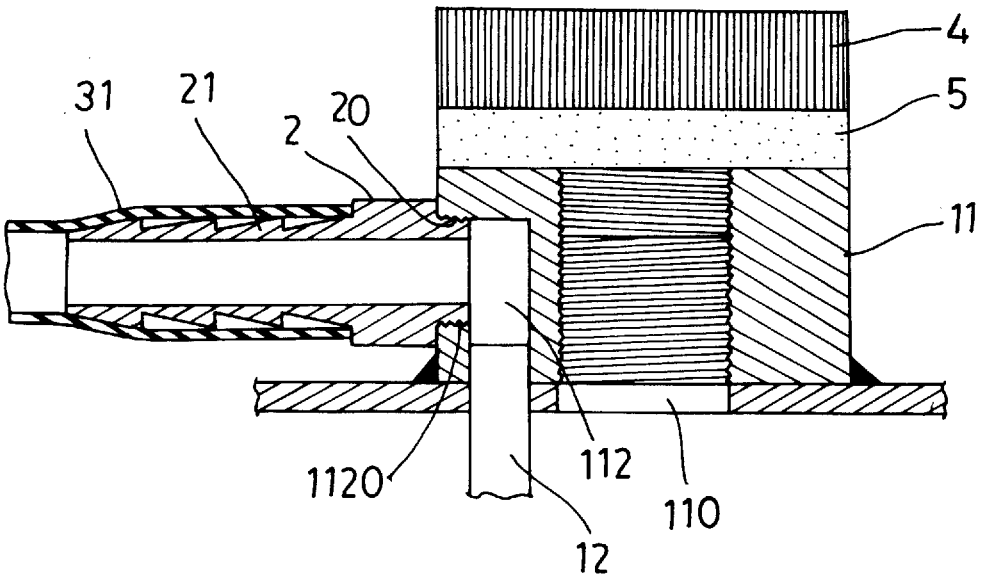
FIG. 4 is a cross-sectional view of the ring combined with an inlet nozzle of an air pumping device in the present invention.
Figure 3:
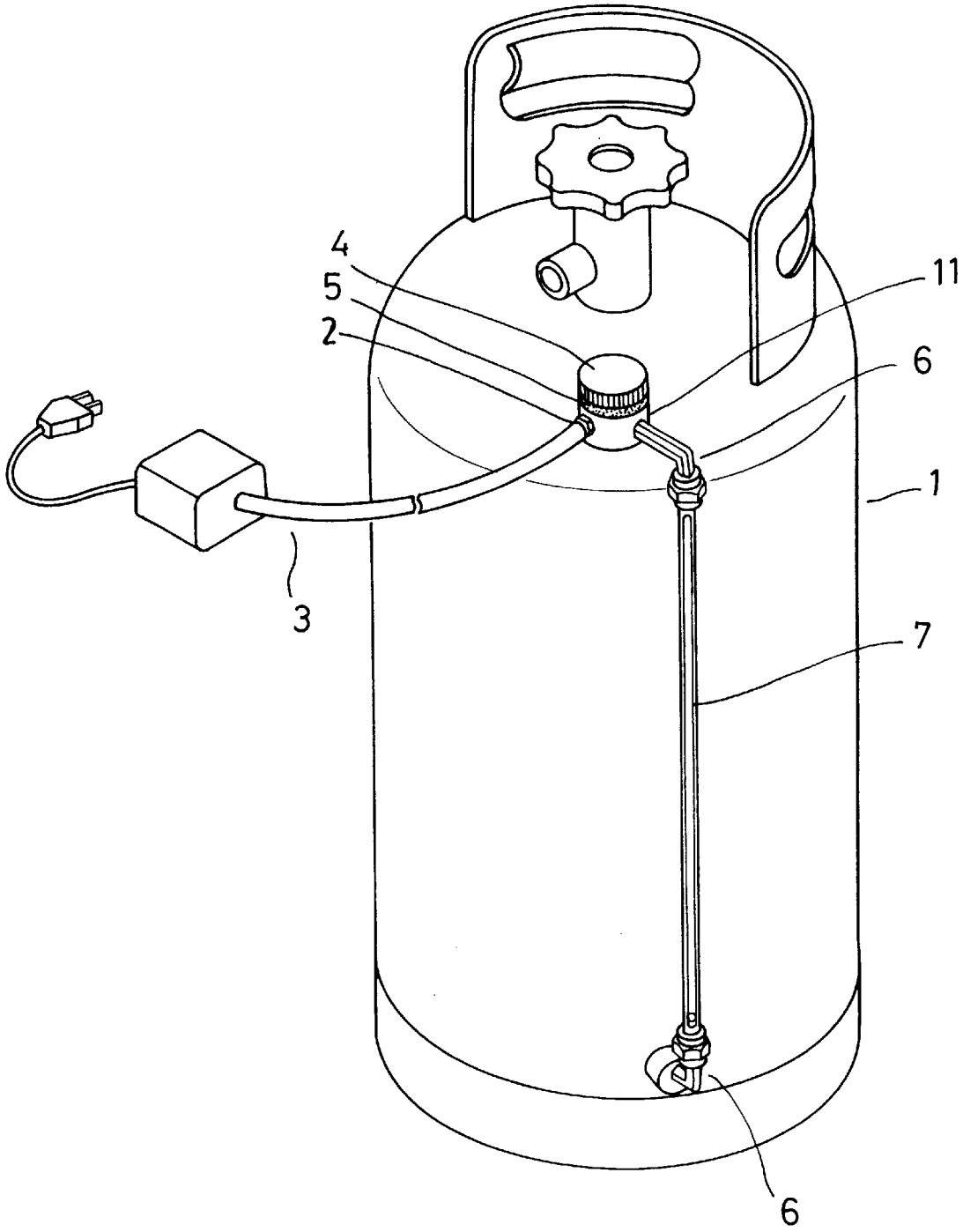
FIG. 3 is a perspective view of the light gas tank with safe inlet device in the present invention.
Figure 5:
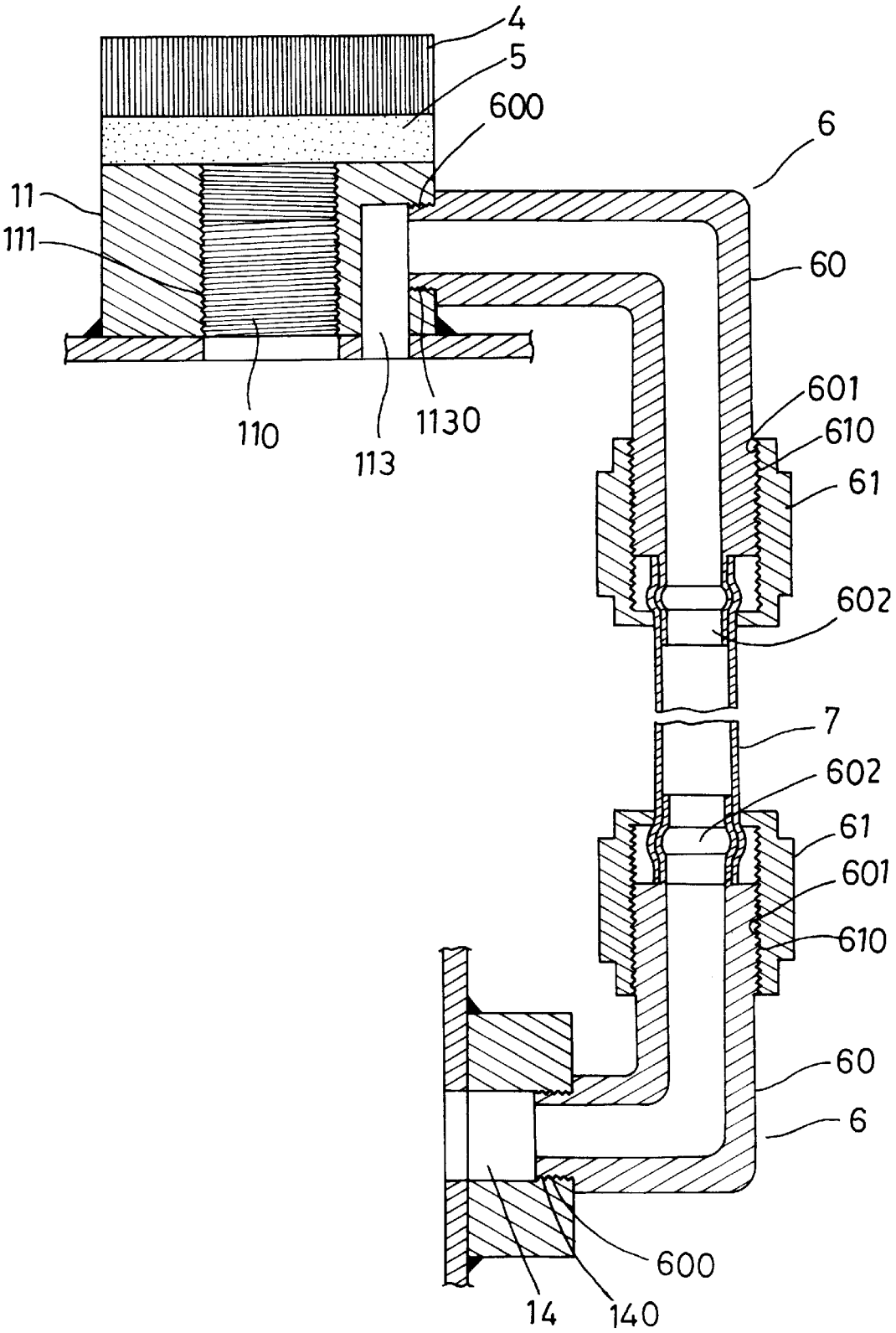
FIG. 5 is a cross-sectional view of the ring combined with a fuel gauge and related components in the present invention; and, FIG. 6 is a perspective and partial cross-sectional view of the light gas tank with a safe inlet device being in use in the present invention.

In assembling, referring to FIGS. 3, 4 and 5, firstly, the male threads 20 of the inlet nozzle 2 are made to engage the female threads 1120 of the passageway 112 of the ring 11, and then the gas tube 31 of the gas pumping device 3 is inserted around the fitting portion 21 of the gas nozzle 2. Next, the male threads 600, 600 of the joint tubes 60, 60 of the two joints 6, 6 are respectively engaged with the female threads 1130, 140 of the passageway 113 and the lower hole 14. Then the two ends of the fuel gauge 7 are respectively inserted in the conctricters 61, 61 of the two joints 6, 6 and further fitted around the fitting portions 602, 602, with the contricters 61, 61 pushed to the joint tube 60, 60 and then rotated to engage the female threads 610, 610 with the male threads 601, 601 of the joint tube 60, 60 so as to secure the fuel gauge 7 on the tank 1. Then the lower portion of the cap 4 is inserted through the gasket 5, letting the male threads 40 engage the female threads 111 of the center fuel inlet 110 of the ring 11, with the gasket 5 sandwiched between the ring 11 and the cap 4, reinforcing tightness of the cap 4 with the fuel inlet 110.

Figure 6:
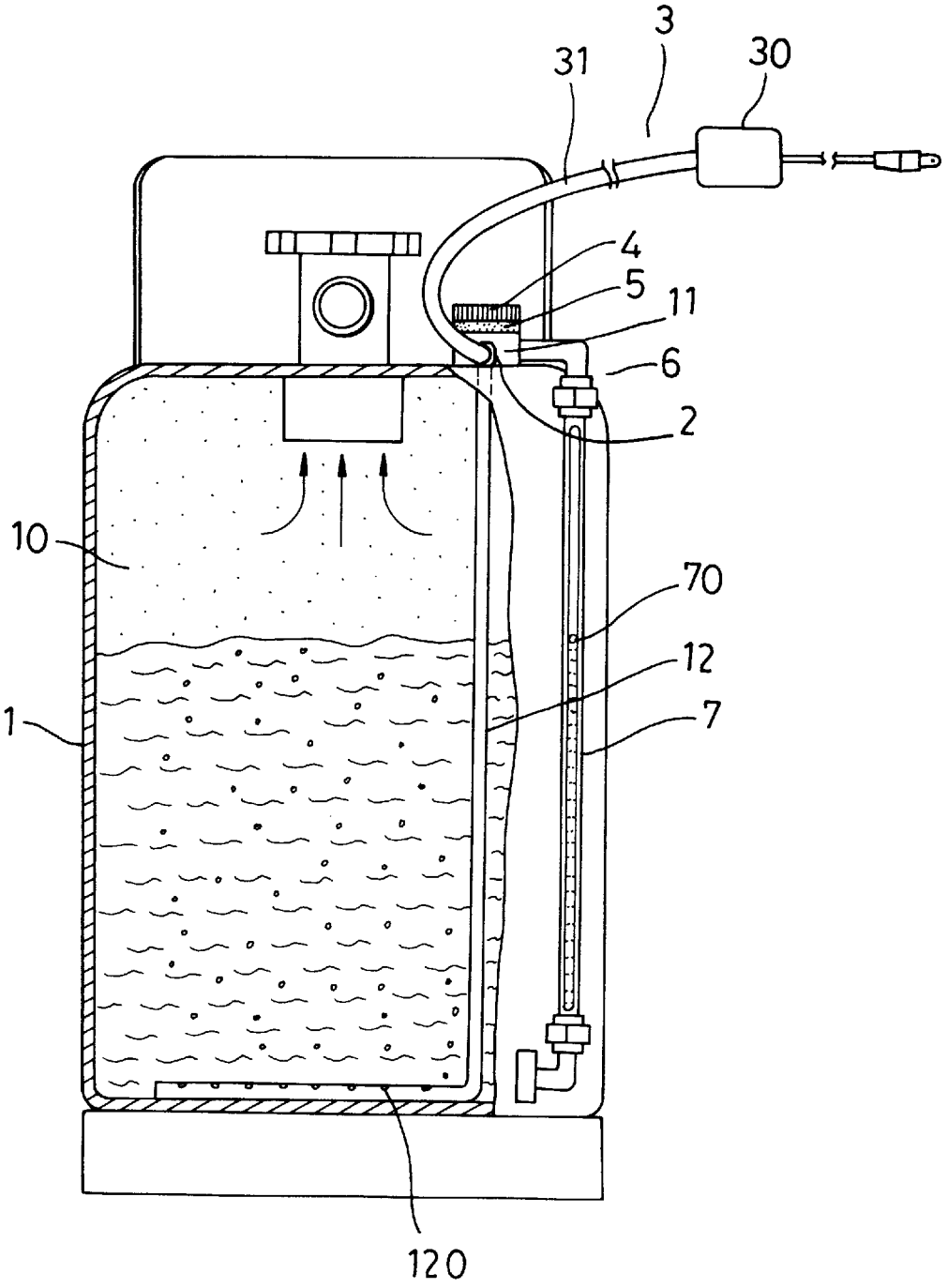

In using, referring to FIG. 6, firstly, the cap 4 and the gasket 5 are removed off the center fuel inlet 110, and then fuel is poured in the hollow interior 10 of the tank 1 through the fuel inlet 110, and fuel in the hollow interior 10 will flow through the lower hole 14 into one of the joint 6 and then in the fuel gauge 7 to force the float 70 move up with the height of the fuel level. Thus, the float 70 can show the height level of the fuel poured in the hollow interior 10 of the tank 1, in other words, it shows the stored volume of the fuel therein. But fuel has to be stopped from filling, when it occupies about three quarters of the hollow interior 10, near the largest limit of volume possible to be held therein. Then the cap 4 with the gasket 5 have to be closed tightly in the ring 11 by rotating the cap 4 to engage the male threads 40 and the female threads 11 together.

The air pumping device 3 is then electrified to operate the pump 30 to send air into the air tube 31, the gas inlet nozzle 2, through the gas inlet 112 of the ring 11 and then through the inlet tube 12 down to flow out of the air holes 120 into the fuel stored in the hollow interior 10 and then flow upward to the hollow space on the fuel. In the meantime the air flowing into the fuel also fused with the fuel to become fuel gas to move the upper hollow space. Then the fuel gas may be controlled by the control valve 13 to flow out for use. Thus, the fuel gas can only be produced when it is needed for use by operating the pumping device 3, diminishing potent danger of explosion caused by strong pressure of large quantity of fuel gas always stored in the tank 1.

The invention has the following advantages, as can be understood by the aforesaid description.

1. A large quantity of fuel gas is not stored in the tank to produce strong pressure therein, preventing potent danger of explosion from happening.

2. The fuel gauge can show the quantity of the fuel stored in the tank, easy to know when to refill it.

3. Fuel can be refilled through the inlet hole in the hollow interior of the tank, without need of replacing with a new tank charged with fuel.

While the preferred embodiment of the invention has been described above, it will be recognized and understood that various modification may be made therein and the appended claims are intended to cover all such modifications which may fall within the spirit and scope of the invention.

What is claimed is:

1. A light gas tank with a safety inlet device comprising:

a tank having a hollow interior for storing fuel therein, a ring fixed on an upper surface and having a center fuel inlet hole communicating with said hollow interior, an inverted L-shaped gas inlet formed in one side of the wall of said ring and having a lower end communicating with said hollow interior, an inverted L-shaped gas passageway formed in the other side of the wall of said ring and having a lower end communicating with said hollow interior, an L-shaped air tube fitted in said inverted L-shaped gas inlet and extending down in said hollow interior to its bottom, said L-shaped air tube having its lower horizontal portion bored with a plurality of air holes spaced apart, and a lower hole bored in a lower portion of the wall of said tank and communicating with said hollow interior;

an inlet nozzle fitted in an upper portion of said inverted L-shaped gas inlet at its inner end;

an air pumping device combined with said inlet nozzle;

a cap threadably closing said center fuel inlet hole of said ring;

a gasket sandwiched tightly between said cap and said ring;

two joints respectively combined with said inverted passageway of said ring and said lower hole of said tank; and, said pumping device pumping air into said L-shaped air tube and out of said air holes of said air tube to fuse with the fuel stored in said hollow interior of said tank to produce fuel gas for use, said fuel gas produced by operating said air pumping device only when it is needed, and thus preventing a large quantity of fuel gas stored in said tank and diminishing potent danger of explosion caused by too large fuel gas pressure in said tank.

2. The light gas tank with a safe inlet device as claimed in claim 1, wherein said center fuel inlet hole of said ring has female threads in the wall defining said center inlet hole, and said cap has a lower portion formed with male threads to engage with said female threads of said center fuel inlet hole of said ring so as to permit said cap combined with said center inlet hole of said ring.

3. The light gas tank with a safe inlet device as claimed in claim 1, wherein said inverted L-shaped gas inlet of said ring has female threads formed in an upper portion to engage with male threads formed on an inner end of said inlet nozzle so as to permit said inlet nozzle combine threadably with said inverted L-shaped gas inlet of said ring.

4. The light gas tank with a safe inlet device as claimed in claim 1, wherein said inverted L-shaped passageway of said ring has female threads formed on an upper portion of said passageway, and said lower hole in said tank is formed with female threads, and said two joints respectively have male threads formed on one end to engage with said female threads of both said ring and said lower hole.

5. The light tank with a safe inlet device as claimed in claim 1, wherein said L-shaped gas tube is welded together with a vertical portion of said inverted L-shaped gas inlet of said ring.

* * * * *